US007017790B1

(12) United States Patent
Peng

(10) Patent No.: US 7,017,790 B1
(45) Date of Patent: Mar. 28, 2006

(54) POSITIONING DEVICE OF A NAIL DRIVER

(76) Inventor: Wei-Chih Peng, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/946,087

(22) Filed: Sep. 22, 2004

(51) Int. Cl.
*B25C 7/00* (2006.01)

(52) U.S. Cl. ..... 227/119; 227/107; 227/110; 227/139

(58) Field of Classification Search ..... 227/8, 227/32, 107, 110, 119, 139, 147
See application file for complete search history.

(56) References Cited

U.S. PATENT DOCUMENTS 2,896,209 A * 7/1959 Hilti ..... 227/147
3,854,648 A * 12/1974 Inzoli et al. ..... 227/136
5,238,167 A 8/1993 Howard
5,452,835 A 9/1995 Shkolnikov
5,671,645 A * 9/1997 Murayama et al. ..... 81/434
5,810,239 A * 9/1998 Stich ..... 227/119
5,918,789 A * 7/1999 Olvera et al. ..... 227/119
6,089,437 A * 7/2000 Blacket et al. ..... 227/136
6,279,808 B1 * 8/2001 Larsen ..... 227/119
6,578,749 B1 * 6/2003 Shen et al. ..... 227/119
6,676,001 B1 * 1/2004 Chen et al. ..... 227/119

* cited by examiner

*Primary Examiner*—Louis K. Huynh
*Assistant Examiner*—Nathaniel Chukwurah

(57) ABSTRACT

A positioning device of a nail driver comprises a tool body; a positioning unit in a front end of the tool body; the positioning unit having a nail output frame and a guide block formed by two sliding blocks; an nail output opening at a front end of the nail output frame formed with two sliding recesses; the two sliding blocks being movable installed into the sliding recesses; a guide opening formed between the two sliding blocks; when the two sliding blocks are separated, the guide opening expands; two positioning plates; each of two sides of the nail output frame having a respective one of the two positioning plates; and two spring elements, each spring element being confined by a respective one of the two positioning plates and a respective one of the two sliding blocks.

3 Claims, 7 Drawing Sheets

POSITIONING DEVICE OF A NAIL DRIVER

FIELD OF THE INVENTION

The present invention relates to nail drivers, and particular to a positioning device of a nail driver, wherein the size of the nail output opening is adjusted elastically with the nail tip end, nail body and the nail head. Thereby, the direction of the nail is calibrated in the shooting process. The present invention has a simple structure and is made with a lower cost.

BACKGROUND OF THE INVENTION

Pneumatic or electromotive nail drivers are more and more popular due the easy operation and steady power supplying properties thereof.

In U.S. Pat. No. 5,238,167 and U.S. Pat. No. 5,452,835, nail drivers are disclosed. In that, the nail output opening of a nail driver has a probe head. A top of the probe head serves as a reference of the nail triggering unit. The probe head is elastic and is turnable in a small range. When the nail is ejected to move forwards, the probe head will be ejected away. Thereby, in triggering, the nail is pushed by the probe head. Thereby, the probe head has the effect of calibrating the direction of the nail. Some nail driver installs a guide block at a nail output opening of a nail driver. When the nail is triggered, the nail will be pushed by the guide block so as to increase the accuracy and stability in beating.

However, the prior art has the following disadvantages.

In triggering, the probe head pushes the nail driver at one side thereof. Although the nail can be shoot steadily, but the beating direction cannot be well controlled to be at a desired angle. Furthermore, when the probe head is collided by the nails repeatedly. It will get elastic fatigue so that the nail cannot be well positioned.

The probe head and the guide block can not be well controlled to beat the nail vertically due to the difficulty in controlling the beating force, while the positioning structure is not a strict symmetrical structure. Thereby, the efficiency in work is reduced.

The prior art positioning device of a nail driver has a very complicate structure. Not only the assembly cost is high, but also the fault ratio of the product is high. Thereby, the prior art is necessary to be improved.

SUMMARY OF THE INVENTION

Accordingly, the primary object of the present invention is to provide a positioning device of a nail driver, wherein the size of the nail output opening is adjusted elastically with the nail tip, nail body and the nail head. Thereby, the direction of the nail is calibrated in the shooting process. The present invention has a simple structure and is made with a lower cost.

To achieve above objects, the present invention provides a positioning device of a nail driver which comprises a tool body; a positioning unit in a front end of the tool body; the positioning unit having a nail output frame and a guide block formed by two sliding blocks; an nail output opening at a front end of the nail output frame formed with two sliding recesses; the two sliding blocks being movable installed into the sliding recesses; a guide opening formed between the two sliding blocks; when the two sliding blocks are separated, the guide opening expands; two positioning plates; each of two sides of the nail output frame having a respective one of the two positioning plates; and two spring elements, each spring element being confined by a respective one of the two positioning plates and a respective one of the two sliding blocks.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
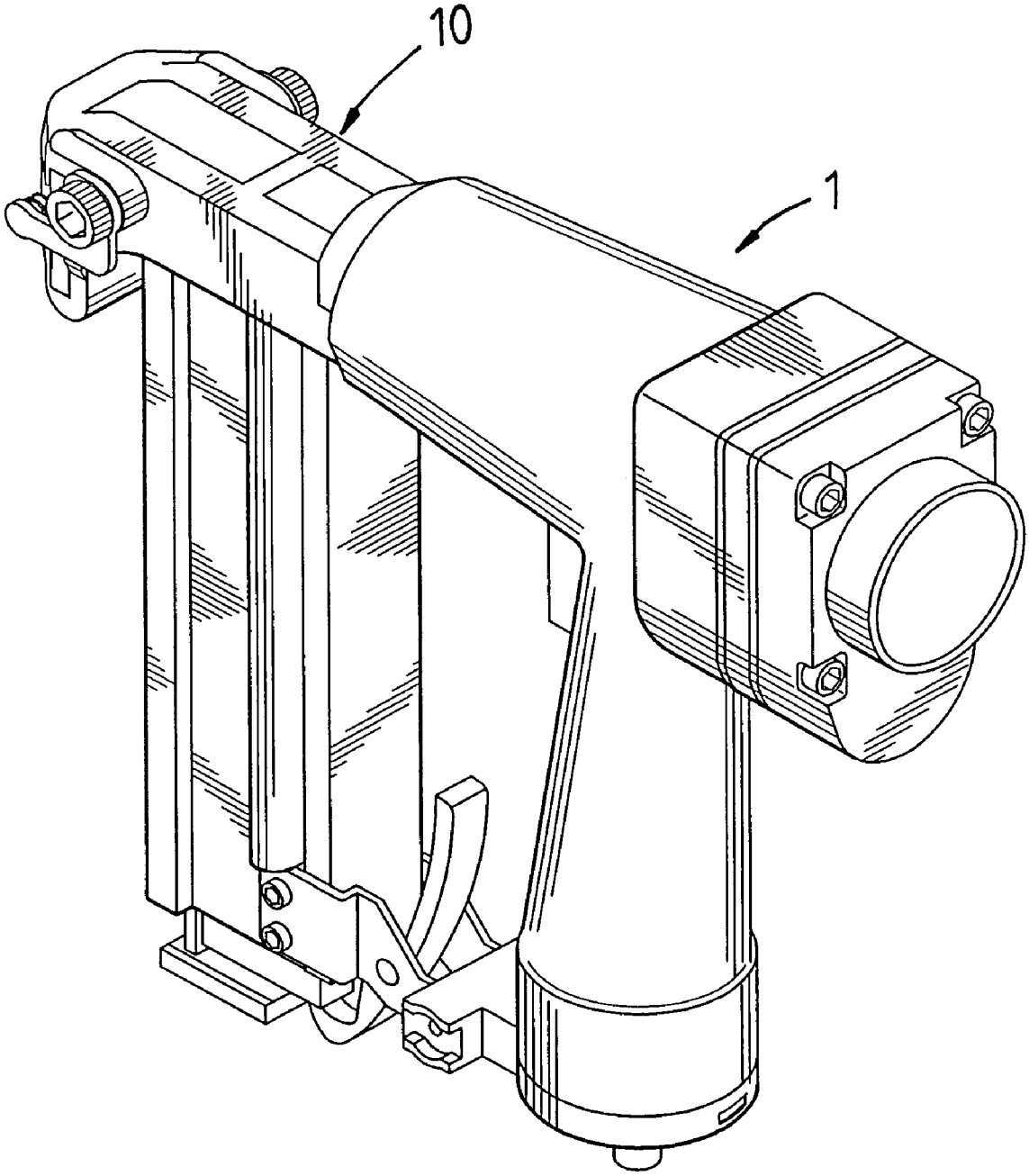
FIG. 1 is a perspective view of the positioning device of a nail driver of the present invention.
Figure 2:
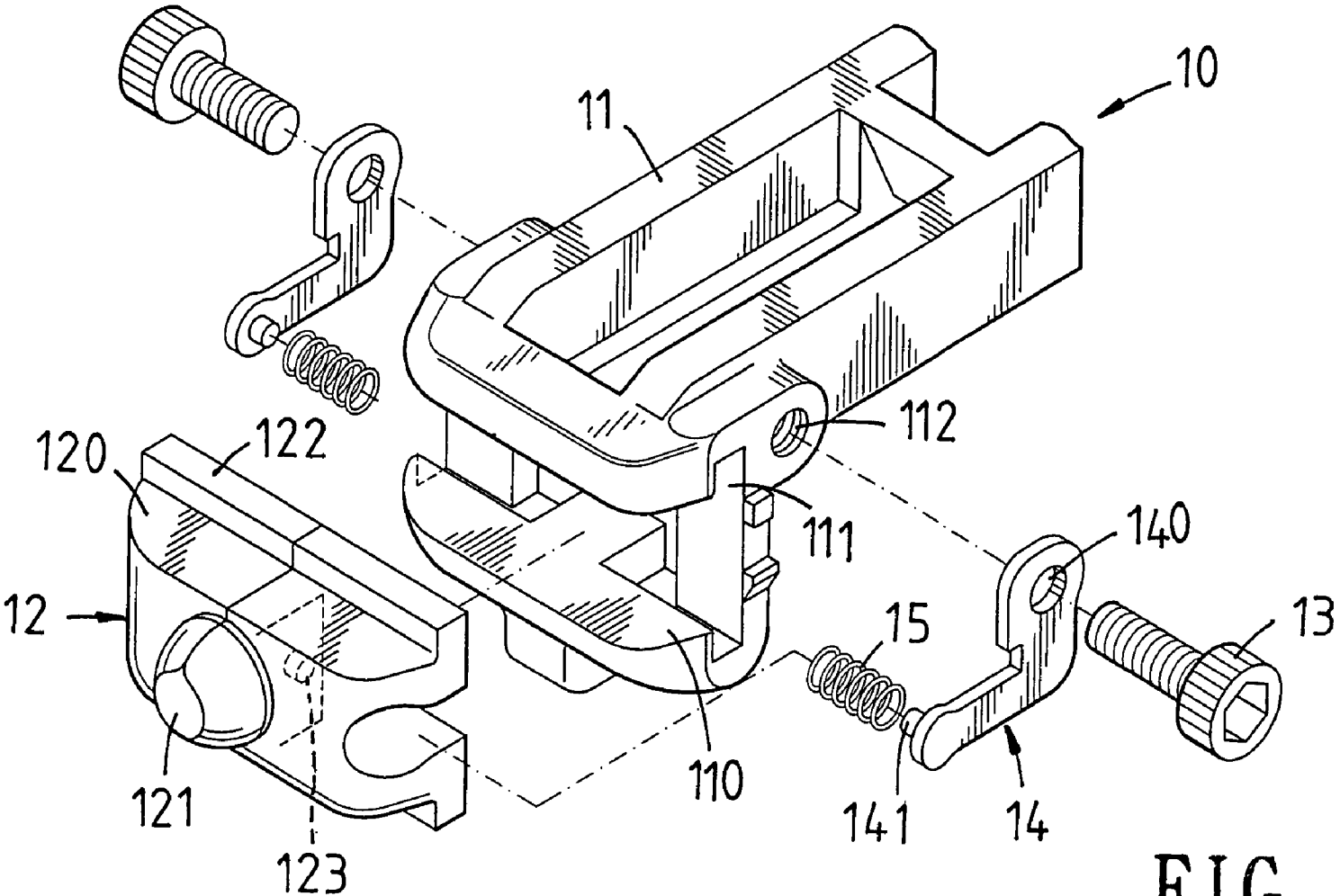
FIG. 2 is an exploded perspective view of the positioning device of a nail driver of the present invention.

With reference to FIGS. 1 and 2, the positioning device of a nail driver of the present invention is illustrated. The positioning device has the following elements.

A tool body 1 is used in the prior art and thus the details will not be described herein.

A positioning unit 10 is installed at a front end of the tool body 1. The positioning unit 10 has a nail output frame 11, a guide block 12, two screw units 13, two positioning plates 14, and two spring elements 15.

The rear end of the nail output frame 11 is connected to a tool body 1. A front end of the nail output frame 11 is a nail output opening 110. Each of an upper side and a lower side of an interior of the nail output opening 110 has a respective sliding recess 111. The sliding recesses 111 serve for positioning the guide blocks 12. Each of two sides of the nail output frame 11 near the two sides of the nail output opening 110 has a respective screw hole 112.

The guide block 12 is formed by a left and a right sliding blocks 120. A center of the guide block 12 has a guide opening 121. An inner side of the guide block 12 is an inclined arc surface with a large rear end and a small front end. The guide opening 121 will enlarge with the separation of the two sliding blocks 120. Each of the upper side and the lower side of the sliding block 120 has a rib 122. By the two ribs 122 to enter into the tow sliding recesses 111, the guide block 12 is slidable along the sliding recesses 111 of the nail output opening 110. A rear side of the sliding block 120 has a resisting portion 123 for resisting against the spring element 15.

Each of the positioning plate 14 has an L shape. One end of the positioning plate 14 has a retaining hole 140 for being screwed by a screw 13 so that the positioning plate 14 is screwed into the screw hole 112 of the nail output frame 11. Another end of the positioning plate 14 is formed with a resisting unit 141. By the resisting unit 141 of the positioning plate 14 and the resisting portions 123 of the sliding blocks 120, the spring element 15 is confined therein. The elastic forces of the spring elements 15 serve to push the sliding blocks 120, the two sliding blocks 120 will move closer and thus the size of the guide opening 121 will be reduced.

Figure 3:
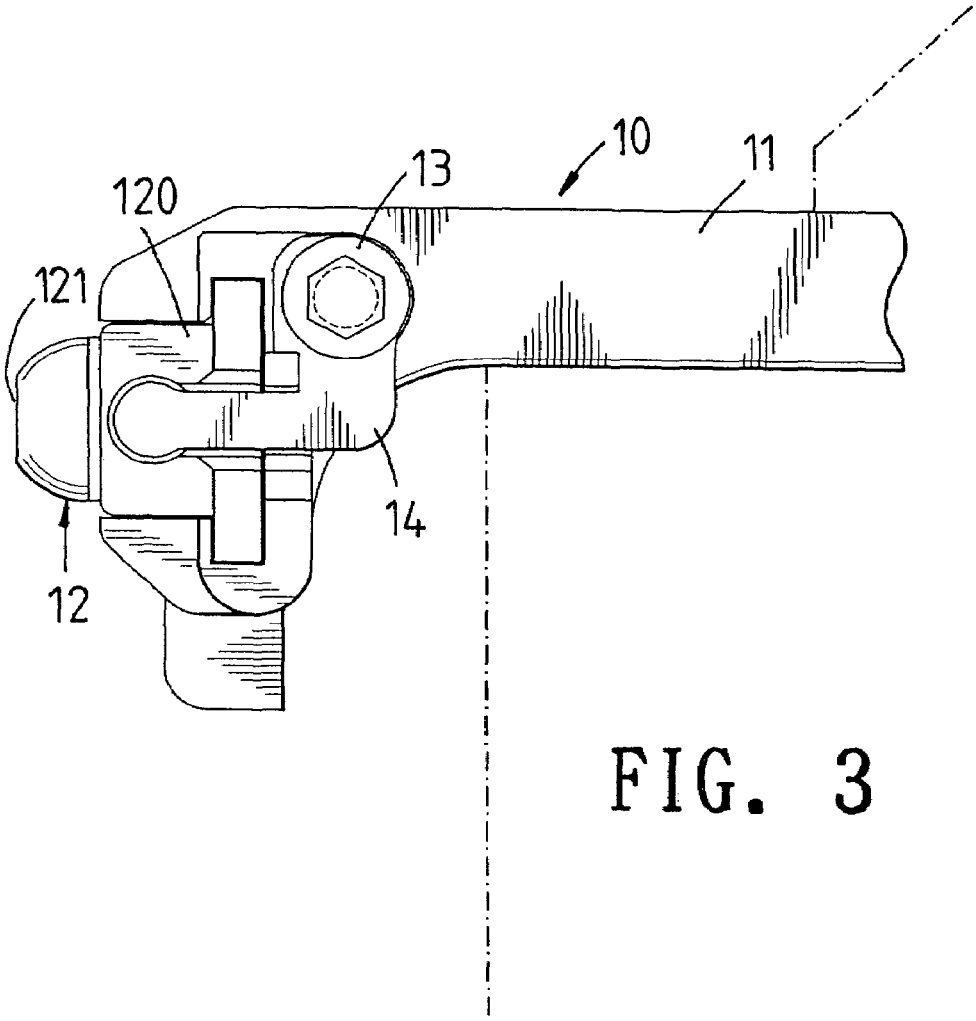
FIG. 3 is a lateral view of the positioning device of a nail driver of the present invention.
Figure 4:
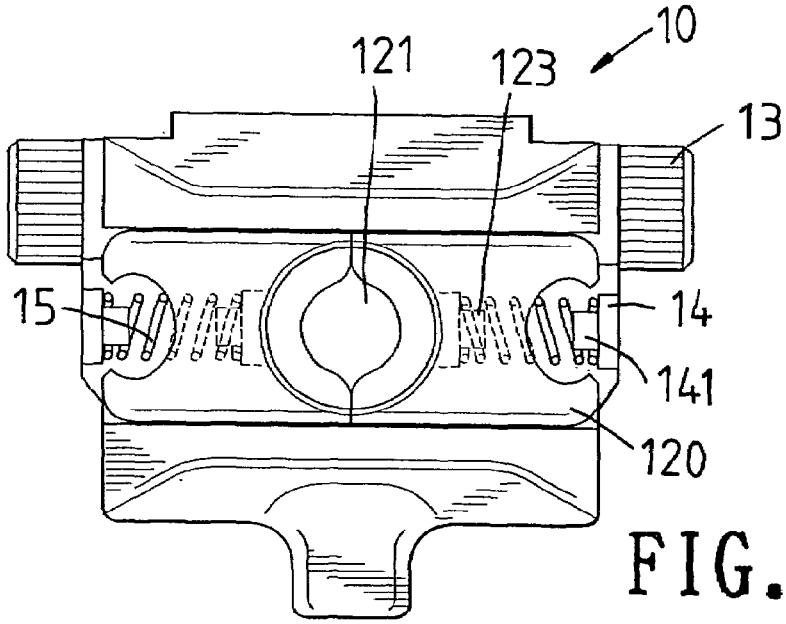
FIG. 4 is a front view of the positioning device of a nail driver of the present invention.
Figure 5:
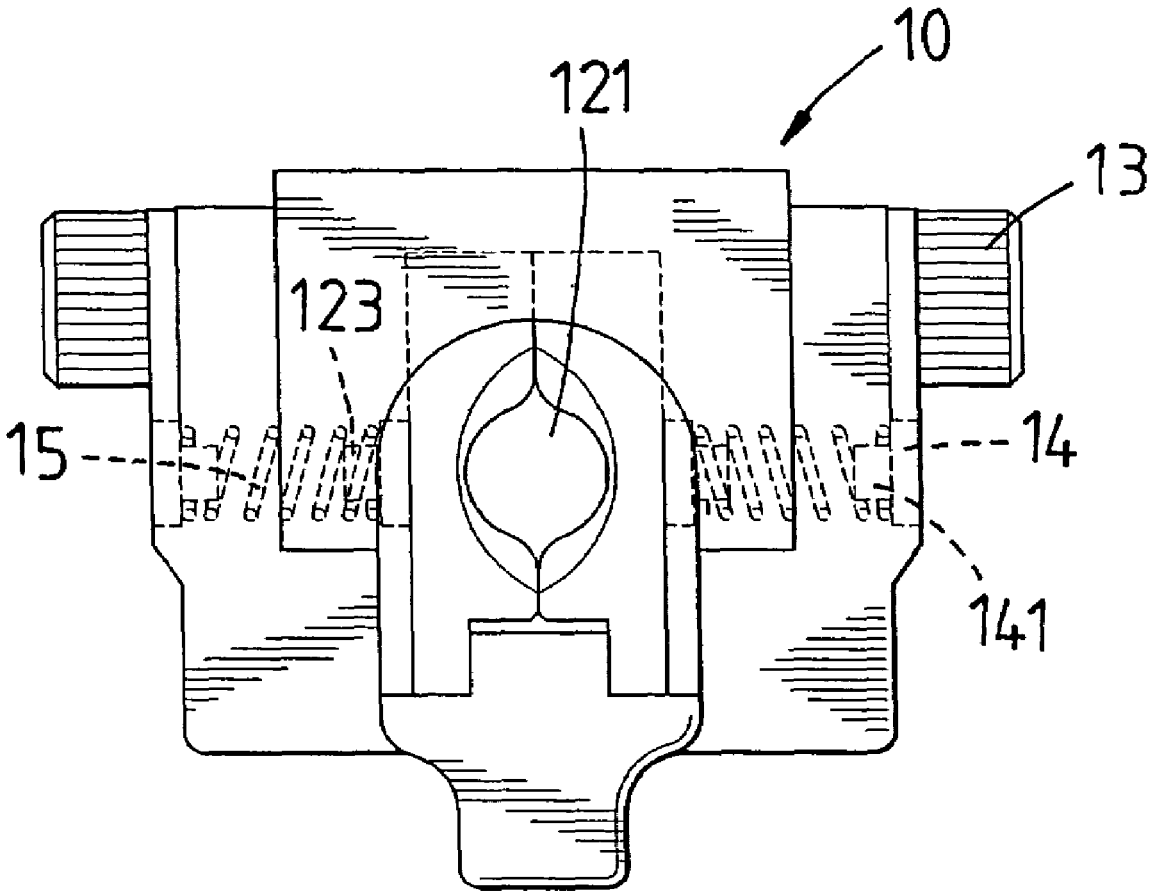
FIG. 5 is a rear view of the positioning device of a nail driver of the present invention.
Figure 6:
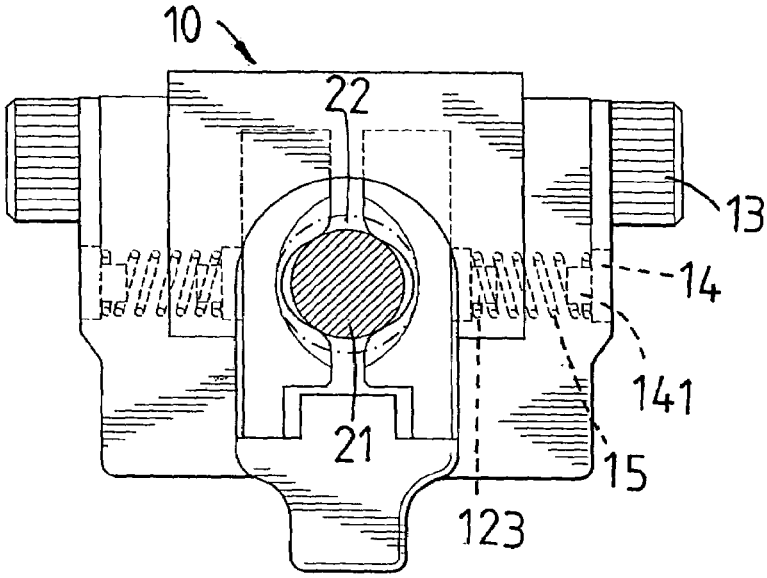
FIGS. 6 and 7 are rear views of the positioning device of a nail driver of the present invention.
Figure 7:
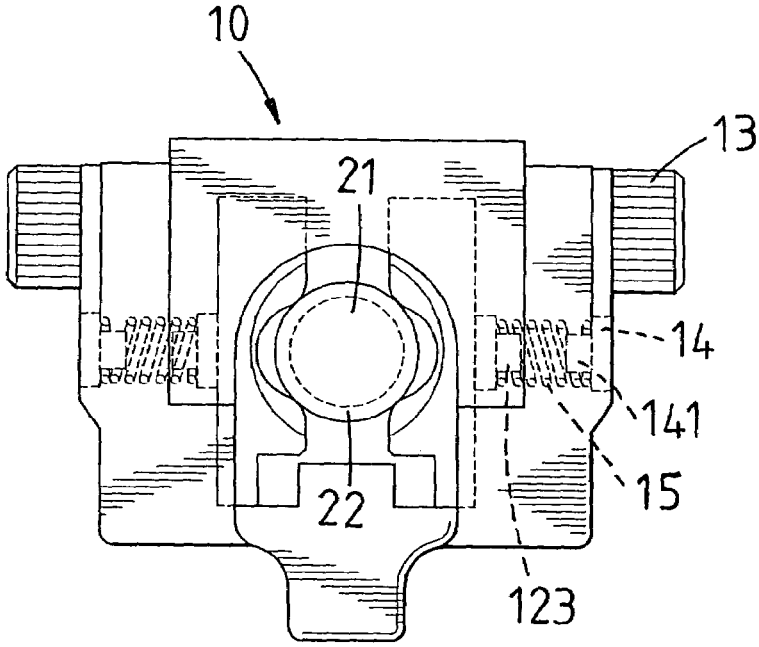
Figure 8:
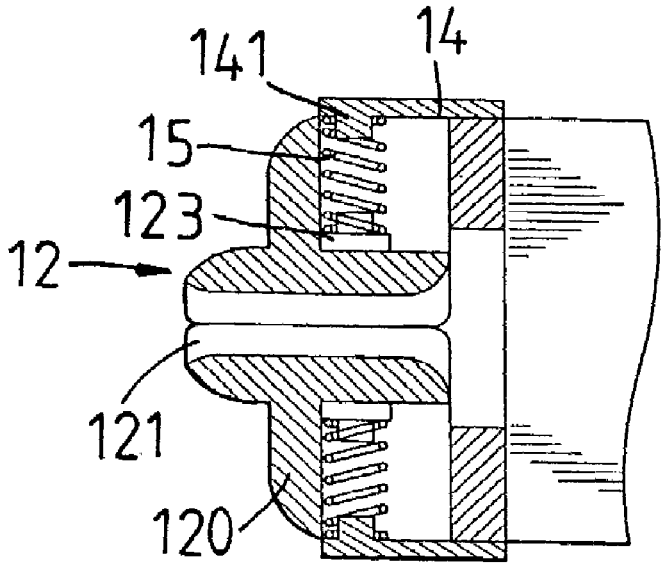
FIGS. 8, 9, 10 and 11 are the longitudinal cross section views of the positioning device of a nail driver of the present invention.
Figure 9:
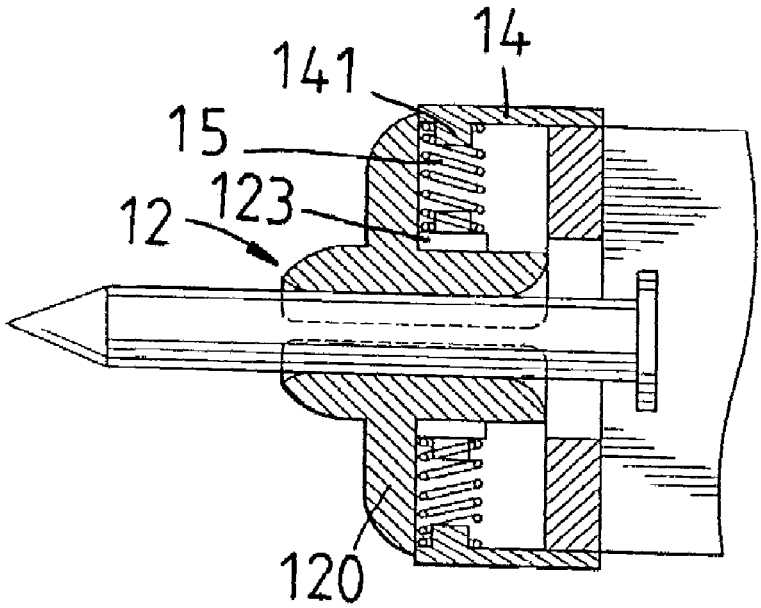
Figure 10:
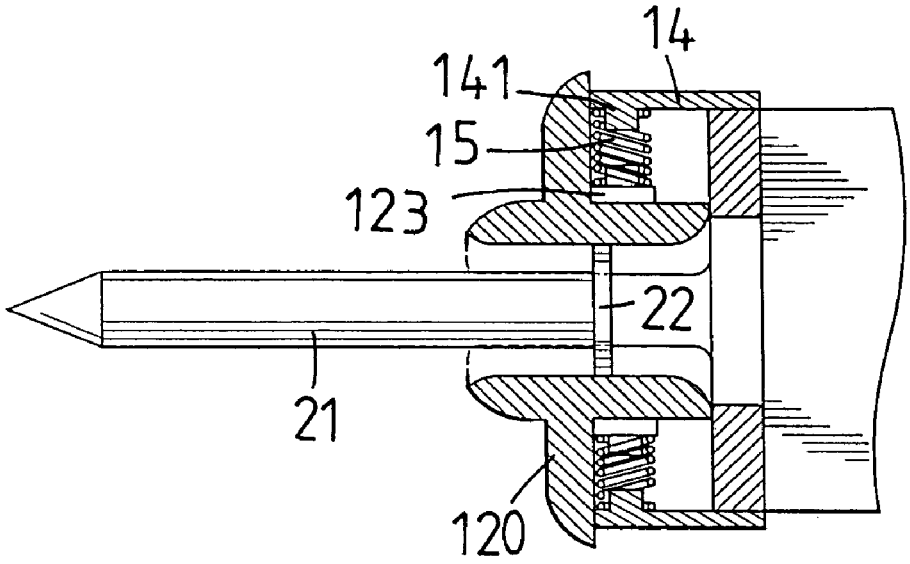

Referring to FIGS. 3 and 4, in assembly of the present invention, the ribs 122 of the two sliding blocks 120 of the guide blocks 12 are engaged into the sliding recesses 111 of the nail output opening 110. The two sliding blocks 120 are movable rightwards or leftwards. The spring elements 15 are resisted against the resisting portions 123 of the sliding blocks 120. Then the resisting units 141 of the positioning plates 14 serve to position the spring element 15 to be between the sliding blocks 120 and the positioning plates 14. Then the screw 13 pass through the retaining holes 140 of the positioning plates 14 and then screw to the screw holes 112 of the nail output frame 11. Thus, the positioning plates 14 are fixed to the nail output frame 11. By one end of the resisting unit 141 of the positioning plate 14 to resisting against the spring element, another end of the spring element 15 resists against the resisting portion 123 of the sliding block 120. Thus, when no external force applies to the two sliding blocks 120, the two sliding blocks 120 are adhered to one another.

Figure 11:
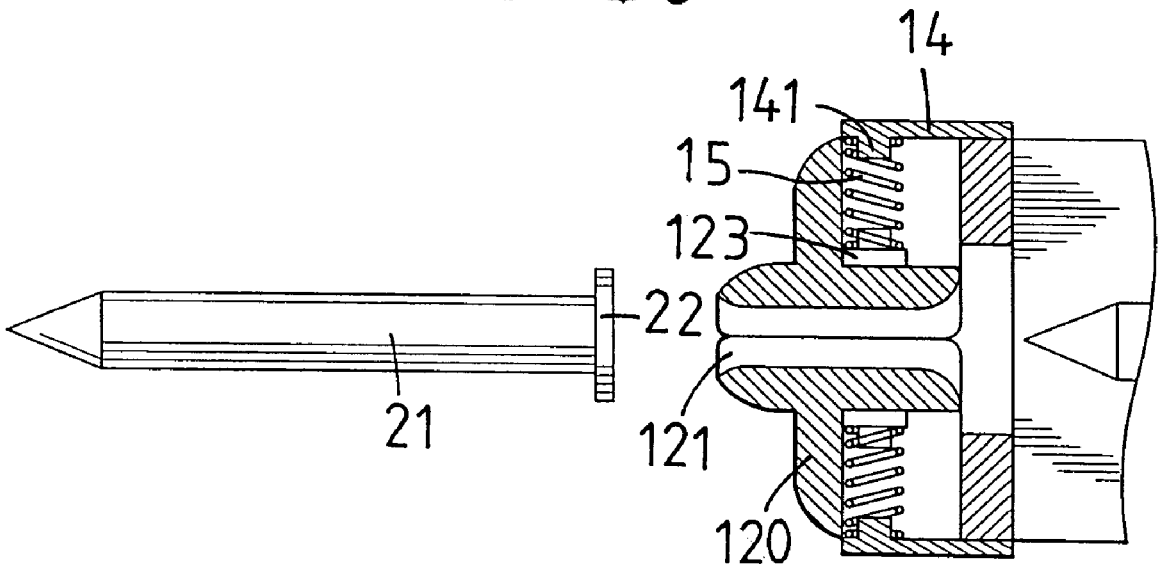

Referring to FIGS. 5 to 11, in use of the present invention, when the nail is triggered, a tip of the nail will insert into the guide opening 121 of the guide block 12. Then the nail body 21 of the nail will pass through the guide opening 121. Since the nail body of the nail is larger than nail output opening 110. A rear side of the nail output opening 110 is an inclined cambered surface. The two sliding blocks will be pushed leftwards and rightwards so as to enlarge the nail output opening 110. Since the two sliding blocks 120 are pushed by the two positioning plates 14 and the two spring elements 15. The nail output opening 110 is pushed to make the nail body just only pass therethrough. When the nail head 22 of the nail passes through the guide opening 121, since the nail head 22 is larger than the nail body, the sliding blocks 120 will be pushed leftwards and rightwards further. Therefore, the guide opening 121 expands further so that the nail is ejected out from the guide opening 121. Thus, by the expansion and compression of the guide opening 121, the shooting direction of the nail is corrected to a right one. Thereby, the positioning device of a nail driver not only saves the cost of the trigger device, but also the assembled time and lose of the nail are reduced. Thus, the user can operate conveniently. After the nail head passes out of the guide opening 121, as shown in FIG. 11, the expansion of the sliding blocks 120 are released. Thus the two sliding blocks 120 are move closer by the compressing forces of the two spring elements. Referring to FIG. 11, when the nail head is placed in the guide opening 121, as the expansion forces from the sliding blocks 120 are released, the two sliding blocks 120 move closer by the pushing forces from the two spring elements 15.

Furthermore, in the present invention, the nail driver is one of a pneumatic nail driver and an electromotive nail driver.

Moreover, in the present invention, the nail driver is a nail driving gun for triggering a nail from the nail driving gun or the nail driver is a palm hammer type nail driver.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A positioning device of a nail driver comprising:

a tool body;

a positioning unit in a front end of the tool body; the positioning unit having a nail output frame and a guide block formed by two sliding blocks;

a nail output opening at a front end of the nail output frame; the nail output opening being between two sliding recesses; two sliding blocks being movable installed into the sliding recesses;

a guide opening formed between the two sliding blocks; when the two sliding blocks are separated, the guide opening expands; two positioning plates; each of two sides of the nail output frame having a respective one of the two positioning plates;

two spring elements, each spring element being confined by a respective one of the two positioning plates and a respective one of the two sliding blocks so that when no external force applies to the sliding blocks; the two sliding blocks move closer to one another by elastic forces of the spring elements; wherein a front end of the nail output frame is the nail output opening; each of an upper side and lower side of an interior of the nail output opening has a respective sliding recess; the sliding recesses serve for positioning the guide block.

2. A positioning device of a nail driver comprising:

a tool body;

a positioning unit in a front end of the tool body; the positioning unit having a nail output frame and a guide block formed by two sliding blocks;

a nail output opening at a front end of the nail output frame; the nail output opening being between two sliding recesses; the two sliding blocks being movable installed into the sliding recesses;

a guide opening formed between the two sliding blocks; when the two sliding blocks are separated, the guide opening expands; two positioning plates; each of two sides of the nail output frame having a respective one of the two positioning plates;

two spring elements each spring element being confined by a respective one of the two positioning plates and a respective one of the two sliding blocks so that when no external force applies to the sliding blocks; the two sliding blocks move closer to one another by elastic forces of the spring elements; wherein an inner side of the guide block is an inclined arc surface with a large rear end and a small front end; the guide opening will enlarge with the separation of the two sliding blocks; and each of the upper side and the lower side of the sliding block has a rib; by the two ribs, the guide block is slidable along sliding recesses of the nail output opening; and a rear side of the sliding block has a resisting portion for resisting against the spring element.

3. A positioning device of a driver comprising:

a tool body;

a positioning unit in a front end of the tool body; the positioning unit having a nail output frame and a guide block formed by two sliding blocks;

a nail output opening at a front end of the nail output frame; the nail output opening being between two sliding recesses; the two sliding blocks being movable installed into the sliding recesses;

a guide opening formed between the two sliding blocks; when the two sliding blocks are separated, the guide opening expands;

two positioning plates; each of two sides of the nail output frame having a respective one of the two positioning plates;

two spring elements, each spring element being confined by a respective one of the two positioning plates and a respective one of the two sliding blocks so that when no external force applies to the sliding blocks; the two sliding blocks move closer to one another by elastic forces of the spring elements; wherein each of the positioning plate has an L shape; one end of the positioning plate has a retaining hole for being screwed by a screw so that the positioning plate is screwed into the screw holes of the nail output frame; another end of the positioning plate is formed with a resisting unit; by the resisting unit of the positioning plate and the resisting portions of the sliding blocks, the spring element is confined therein.

* * * * *